US007295222B2

(12) United States Patent
Kim et al.

(10) Patent No.: US 7,295,222 B2
(45) Date of Patent: Nov. 13, 2007

(54) IMAGE FORMING APPARATUS FOR DOUBLE-SIDED PRINTING AND METHOD OF USING THE SAME

(75) Inventors: Soo-hyun Kim, Suwon-si (KR); Heon-soo Park, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 196 days.

(21) Appl. No.: 11/143,629

(22) Filed: Jun. 3, 2005

(65) Prior Publication Data

US 2005/0280692 A1 Dec. 22, 2005

(30) Foreign Application Priority Data

Jun. 22, 2004 (KR) ..... 10-2004-0046557

(51) Int. Cl.
*B41J 2/32* (2006.01)

(52) U.S. Cl. ..... 347/171; 347/172; 347/104; 400/108

(58) Field of Classification Search ..... 347/171, 347/172, 174, 176, 104, 108; 400/188
See application file for complete search history.

(56) References Cited

U.S. PATENT DOCUMENTS 6,601,952 B2 * 8/2003 Sugioka et al. ..... 347/104
6,705,786 B2 * 3/2004 Trovinger ..... 400/645.3
2003/0125206 A1 7/2003 Bhatt
2003/0194253 A1 * 10/2003 Trovinger ..... 400/188

FOREIGN PATENT DOCUMENTS

| | | |
|---|---|---|
| JP | 07-081177 | 3/1995 |
| JP | 11-091175 | 4/1999 |
| JP | 2001-071606 | 3/2001 |
| JP | 2001-205891 | 7/2001 |
| JP | 2001-310503 | 11/2001 |
| JP | 2002-051196 | 2/2002 |
| JP | 2002-144615 | 5/2002 |
| JP | 2002-273963 | 9/2002 |
| JP | 2002-283635 | 10/2002 |
| JP | 2003-276257 | 9/2003 |
| KR | 10-1989-0009205 | 6/1989 |
| KR | 10-1996-0074781 | 12/1996 |
| KR | 100269657 | 7/2000 |

* cited by examiner

*Primary Examiner*—Huan Tran
(74) *Attorney, Agent, or Firm*—Roylance, Abrams, Berdo & Goodman, L.L.P.

(57) ABSTRACT

An image forming apparatus includes a printing module that prints an image on a medium. A transfer unit transfers the medium. A rotating unit rotates the transfer unit such that first and second surfaces of the medium selectively face the printing module when the medium is pinched in the transfer unit.

25 Claims, 13 Drawing Sheets

IMAGE FORMING APPARATUS FOR DOUBLE-SIDED PRINTING AND METHOD OF USING THE SAME

CROSS REFERENCE TO RELATED APPLICATION

This application claims the benefit under 35 U.S.C. § 119(a) of Korean Patent Application No. 10-2004-0046557, filed on, Jun. 22, 2004, in the Korean Intellectual Property Office, the entire disclosure of which is hereby incorporated by reference.

BACKGROUND OF THE INVENTION

1. Field of the Invention

The present invention relates to an image forming apparatus and an image forming method. More particularly, the present invention relates to an image forming apparatus for double-sided printing and a method of using the same.

2. Description of the Related Art

In a thermosensitive type image forming apparatus, a thermal printing head (TPH) applies heat to an ink ribbon contacting a medium to transfer ink to the medium, or a TPH applies heat to a medium on which an ink layer thermally reacts to realize a predetermined color, thereby forming an image. Japanese Patent Laid-open Publications JP11-091175, JP14-283635, and JP14-273963 disclose the thermosensitive image forming apparatus.

First and second TPHs that contact opposite sides of a medium are used for double-sided printing. When two TPHs are used, the manufacturing costs of an image forming apparatus are increased. Accordingly, a thermosensitive image forming apparatus in which two sides of a medium are sequentially in contact with a TPH is required to print images on both sides of the medium with one TPH.

When an inkjet image forming apparatus or an electrophotographic image forming apparatus is equipped with two inkjet heads or two electrophotographic process modules for double-sided printing, manufacturing costs are increased. Accordingly, two sides of a medium must be sequentially in contact with an inkjet head or an electrophotographic process module to realize double-sided printing with only one inkjet head or electrophotographic process module.

Accordingly, a need exists for an improved image forming apparatus capable of double-sided printing with one printing module.

SUMMARY OF THE INVENTION

The present invention provides an image forming apparatus that prints images on both sides of a medium using one printing module, and a method of using the same.

According to an aspect of the present invention, an image forming apparatus includes a printing module that prints an image on a medium. A transfer unit transfers the medium. A rotating unit rotates the transfer unit such that first and second surfaces of the medium selectively face the printing module when the medium is pinched in the transfer unit.

The medium may be a thermosensitive medium in which ink layers formed on both sides of the medium react with heat to reveal a predetermined color. The printing module may include a thermal printing head that applies heat to the medium to form an image.

The transfer unit may include a driving roller and a driven roller that are engaged with each other to transfer the medium. The image forming apparatus may include a feeding device in which the medium are loaded. A pickup device extracts the medium from the feeding device. A second motor drives the driving roller and the pickup device.

The image forming apparatus may further include a platen that faces the thermal printing head to support the medium and an elastic element that elastically biases the thermal printing head toward the platen. The platen may rotate with the medium and be rotated while the medium is transferred by the transfer unit. The apparatus may further include a second shifting unit that selectively separates the thermal printing head from the platen.

The apparatus may further include a feeding device in which the medium is loaded. A pickup device extracts the medium from the feeding device. A third shifting unit shifts the feeding device toward the pickup device when picking up the medium and separates the feeding device from the pickup device when the medium has been extracted.

The medium may be a color printing medium in which ink layers representing different colors are formed on both sides of the medium such that the colors overlap to form a color image after printing is performed.

The apparatus may further include a housing that houses the printing module, the transfer unit and the rotating unit. The transfer unit is exposed outside of the housing.

According to an aspect of the present invention, an image forming method includes a printing module that prints an image on a medium and a transfer unit that is located at an exit side of the printing module to transfer the medium. The method includes facing a first surface of the medium toward the printing module and positioning the medium at a first print starting position. The medium is transferred and an image is printed on the first surface of the medium using the printing module. The transfer unit is rotated to face a second surface of the medium toward the printing module when a rear end of the medium is pinched in the transfer unit. The medium is transferred to position the medium at a second print starting position. The medium is transferred and an image is printed on the second surface of the medium using the printing module.

The medium may be a color printing medium in which ink layers representing different colors are formed on both sides of the medium. The printing module may include a thermal printing head that applies heat to the medium to form an image, and different colors may overlap when printing on both sides of the medium is finished.

The printing module may print images on medium using an electrophotographic method, an inkjet method, or a thermal transfer method.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1A:
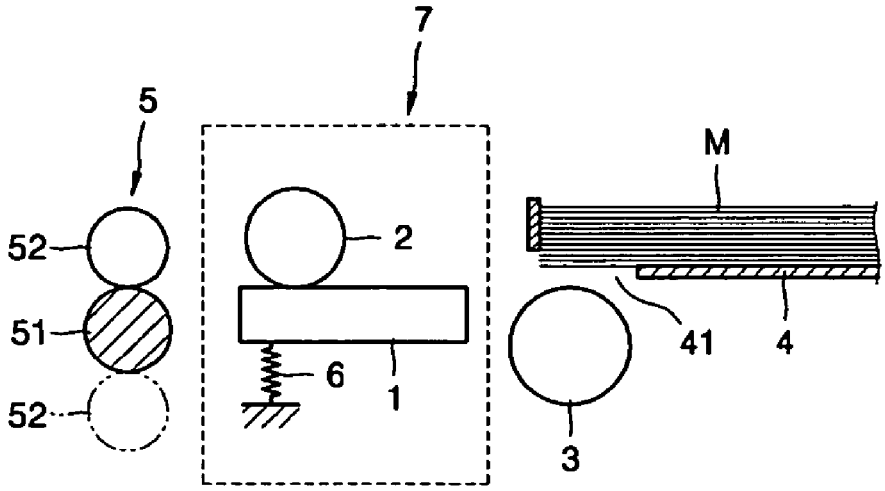
FIGS. 1A through 1I are diagrams illustrating an image forming method according to an exemplary embodiment of the present invention.

FIGS. 1A through 1I are diagrams illustrating an image forming method according to an exemplary embodiment of the present invention. Hereinafter, the image forming method will be described using a thermosensitive type image forming apparatus as an example. Referring to FIG. 1A, a thermal printing head (TPH) 1 and a platen 2 are adjacent to each other. In the TPH 1, a plurality of micro sized heating devices are arranged and separated by a predetermined resolution interval. The heating devices are individually controlled to form an image. The platen 2 supports a medium M to sufficiently transmit heat generated by the heating devices to the medium M. A spring 6 pushes the TPH 1 toward the platen 2. A transfer unit 5 includes driving rollers 51 and a driven roller 52 that contact each other and rotate to transfer the medium M forward and backward. The transfer unit 5 is located at an exit side of the TPH 1. A pickup roller 3 extracts the medium M from a tray 4. In an exemplary embodiment, the pickup roller 3 is located below the tray 4 and extracts the medium M from the tray 4 via an access hole 41.

Figure 2:
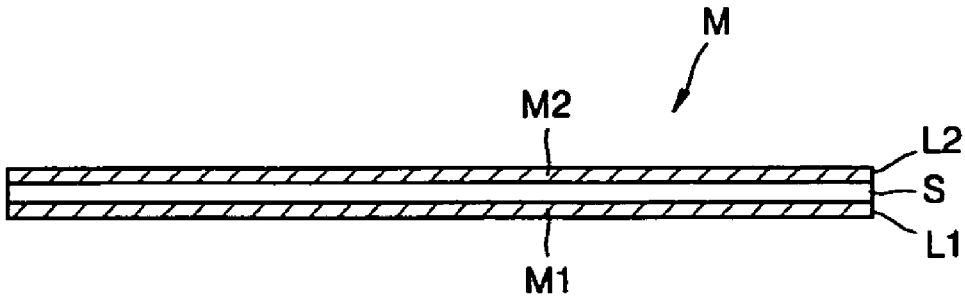
FIG. 2 is a cross-sectional view illustrating a medium that is used in an image forming method and apparatus according to an exemplary embodiment of the present invention.

The medium M may have a configuration as illustrated in FIG. 2. The medium M includes ink layers L1 and L2 of a predetermined color formed on opposite surfaces of the medium, that is, a first surface M1 and a second surface M2 of a base sheet S. The ink layers L1 and L2 may have a single layer structure formed by a single color or a multi-layer structure formed by two or more colors. For example, two layers respectively representing yellow and magenta may be included in the ink layer L1, and a layer representing cyan may be included in the ink layer L2. Yellow and magenta are selectively revealed according to the temperature and heating time. For example, when heat is applied at a high temperature and for a short time, yellow may be revealed, and when heat is applied at a low temperature and for a long time, magenta may be revealed. The opposite arrangement may be used. When the base sheet S is formed of a transparent material, yellow, magenta, and cyan may be revealed, thereby overlapping the three colors to represent a color image. U.S. Patent Publication No. US2003/0125206 discloses the medium described above. As another example, when the base sheet S is composed of opaque material, double-sided printing is possible by printing different images on the first and second surfaces M1 and M2. The technical scope of the image forming method according to an exemplary embodiment of the present invention is not defined by the structure of the ink layers L1 and L2 on the first and second surfaces M1 and M2.

Figure 1B:
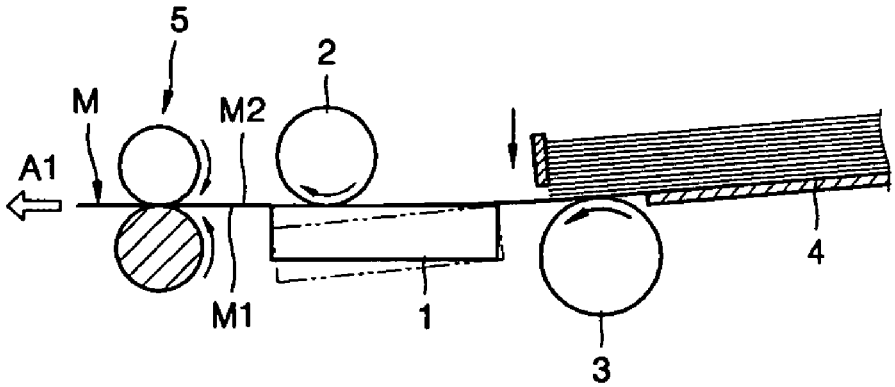

Referring to FIG. 1B, when the tray 4 approaches the pickup roller 3, the pickup roller 3 contacts the medium M via the access hole 41. When the pickup roller 3 is rotated, the medium M is extracted from the tray 4, transferred to the transfer unit 5, and placed in a first print starting position. At this point, the first surface M1 of the medium M faces the TPH 1. In this case, when the medium M is being transferred, as illustrated by dotted lines in FIG. 1B, the TPH 1 is separated from the platen 2 and may contact the platen 2 again when the medium M reaches the first print starting position.

Figure 1C:
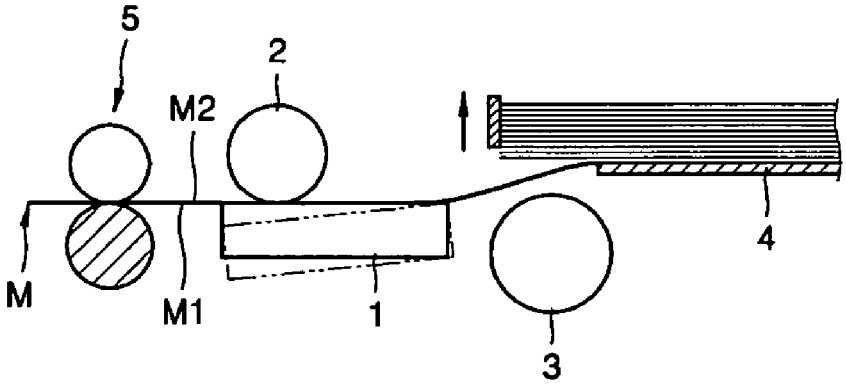
Figure 1D:
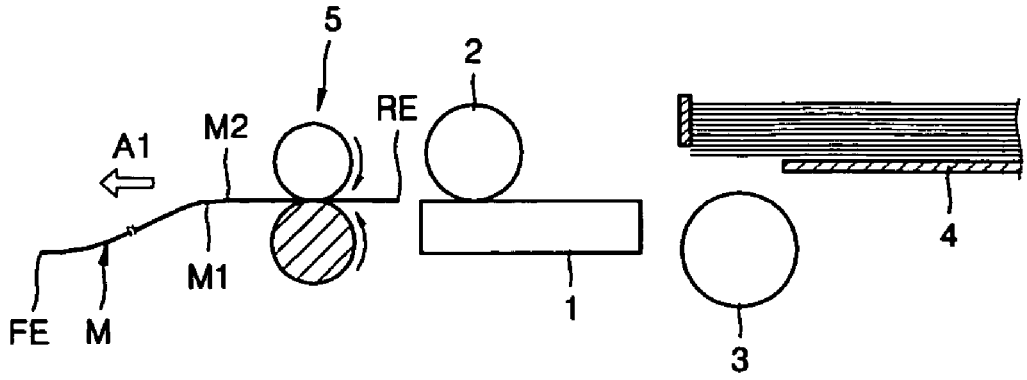
Figure 1E:
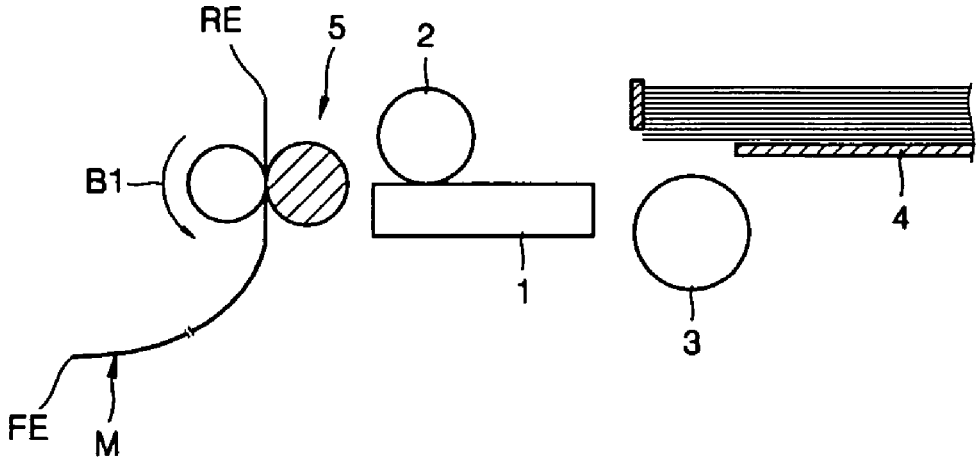
Figure 1F:
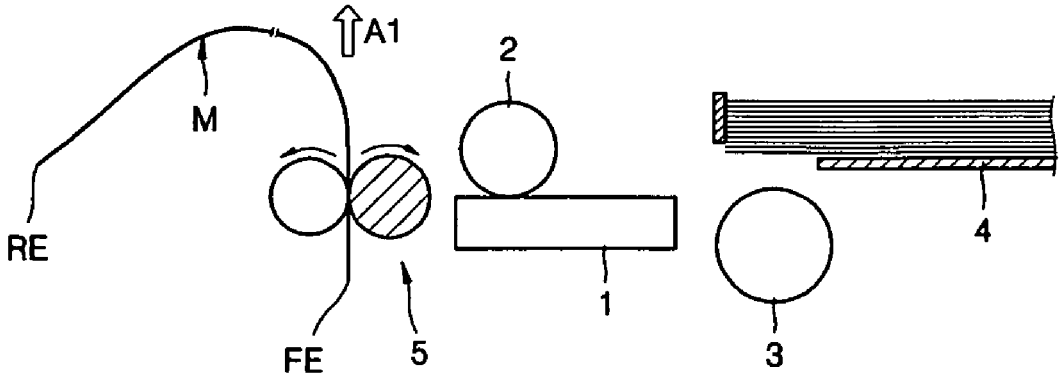

Referring to FIG. 1C, when the medium M arrives at the first print starting position, the tray 4 moves away from the pickup roller 3. Referring to FIG. 1D, the transfer unit 5 transfers the medium M forward in the direction indicated by arrow A1 at a predetermined speed. The TPH 1 applies heat to the first surface M1 of the medium M to form an image thereon.

When the image is formed on the first surface M1, the transfer unit 5 stops transferring before a rear end (RE) of the medium M exists the transfer unit 5. In this state, referring to FIG. 1E, the transfer unit 5 is rotated in the direction indicated by arrow B1 (or the direction opposite of the direction indicated by arrow B1), by approximately 90 degrees. Then, referring to FIG. 1F, the transfer unit 5 transfers the medium M forward in the direction indicated by arrow A1 and stops before a front end (FE) of the medium M exits the transfer unit 5. Next, the transfer unit 5 is rotated in the direction indicated by arrow B1 by approximately 90 degrees. Then, referring to FIG. 1G, the second surface M2 of the medium M faces the TPH 1.

Figure 1G:
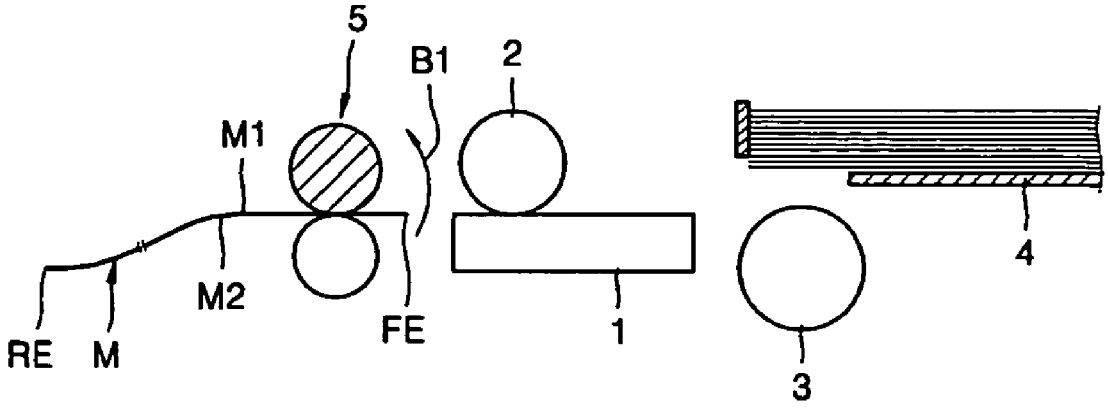
Figure 1H:
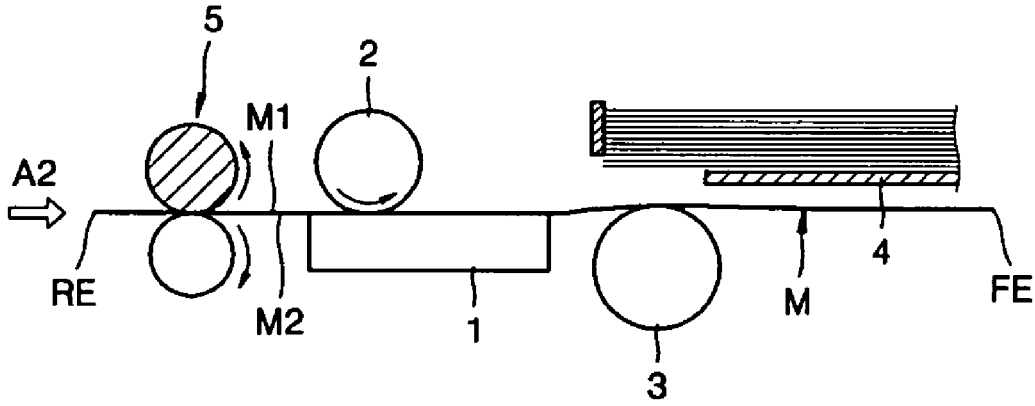
Figure 1I:
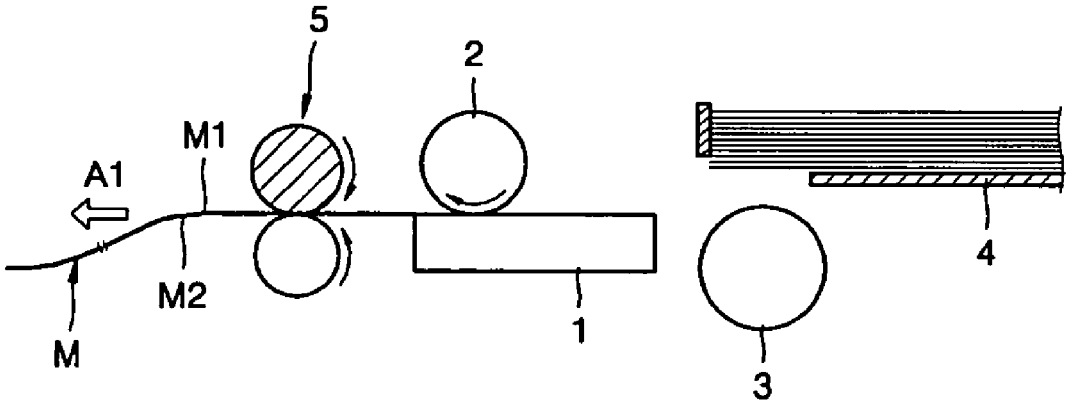

Referring to FIG. 1H, the transfer unit 5 transfers the medium M in the direction indicated by arrow A2 (that is substantially opposite to the direction A1) to a second print starting position, which is a print starting position of the second surface M2. Referring to FIG. 1I, the transfer unit 5 transfers the medium M forward in the direction indicated by arrow A1. The TPH 1 applies heat to the second surface M2 of the medium M to print an image. In this case, a medium M with a transparent base sheet must be exactly fixed such that yellow and magenta images printed on the first surface M1 and a cyan image printed on the second surface M2 accurately overlap.

Images may be printed on both sides of the medium M using one TPH 1 by the process as described above.

FIGS. 1A through 1I illustrate an image forming method applied to a thermosensitive image forming apparatus as an example. However, the technical scope of the image forming method according to the present invention is not limited to this exemplary embodiment. For example, in an image forming method according to another exemplary embodiment of the present invention, ordinary paper having no ink layer is used as a medium. Also, an image forming method according to an exemplary embodiment of the present invention may be applied to a thermal transfer printing image forming apparatus in which an ink ribbon is interposed between the TPH 1 and the medium M, as disclosed in Japan Patent Laid-open Publication Nos. JP14-283635 and JP14-273963. Also, if a printing module 7 is substituted by an inkjet printhead or an electrophotographic printing module, the image forming method according to an exemplary embodiment of the present invention may be applied to an inkjet type image forming apparatus or an electrophotographic image forming apparatus. In this case, a main transfer unit (not shown) for transferring a medium M at a predetermined speed is additionally included in the image forming apparatus, and the transfer unit 5 installed at the exit side of the printing module 7 may assist the main transfer unit.

Figure 3:
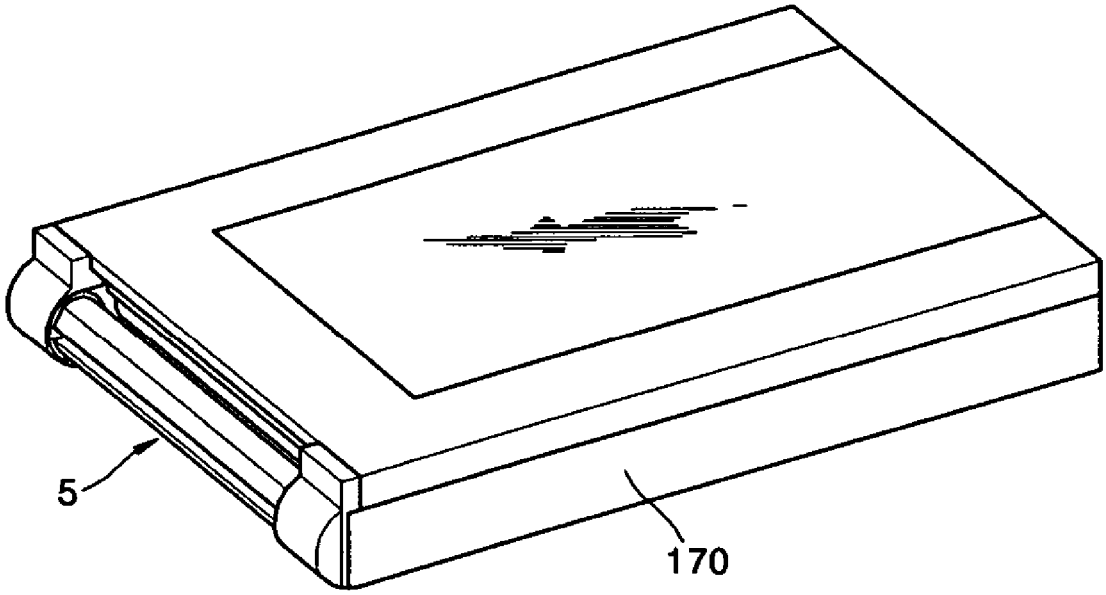
FIG. 3 is an exterior perspective view of a thermosensitive type image forming apparatus according to an exemplary embodiment of the present invention.
Figure 4:
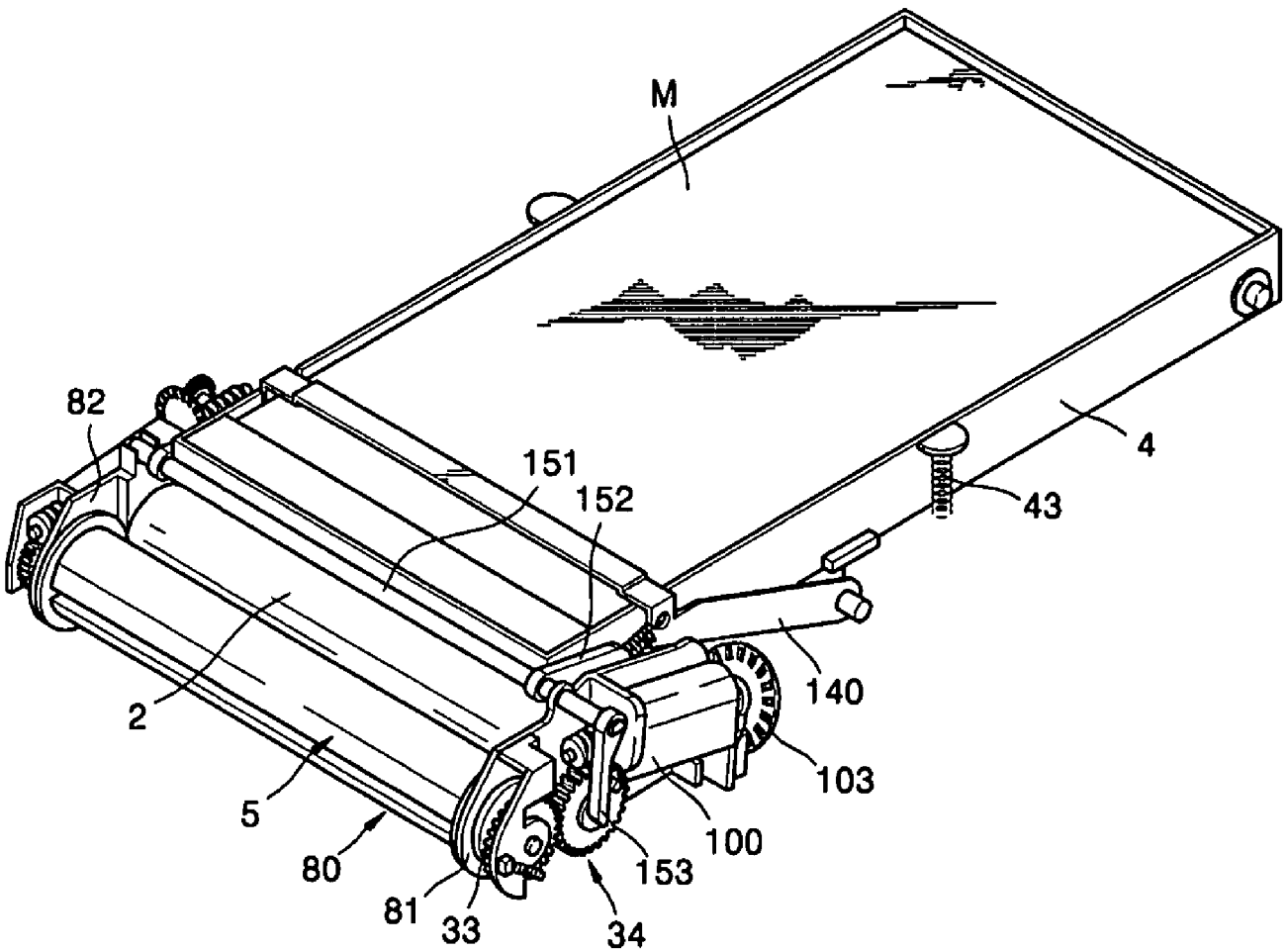
FIGS. 4 and 5 are interior perspective views of the thermosensitive type image forming apparatus according to an exemplary embodiment of the present invention.
Figure 5:
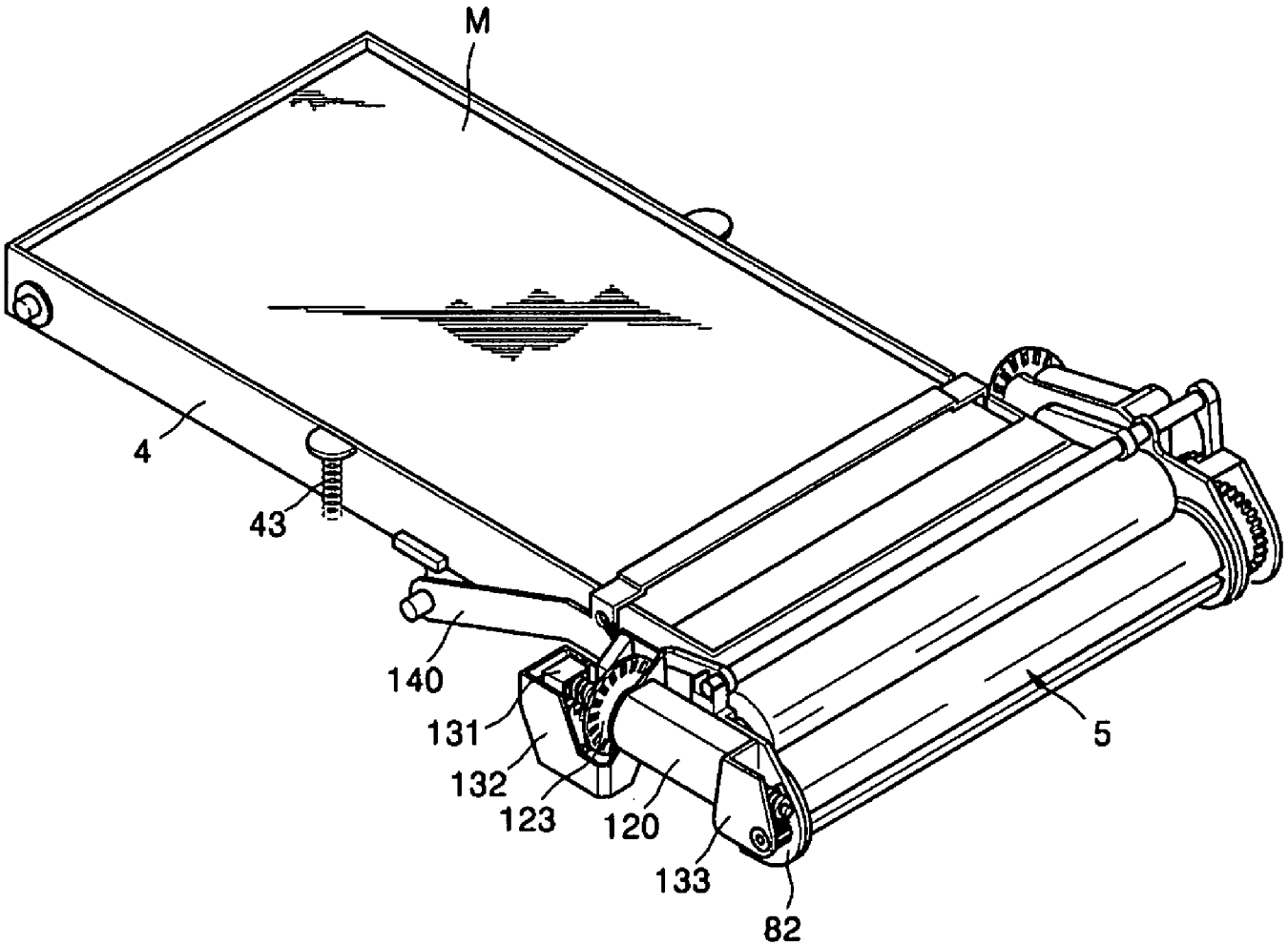
Figure 6:
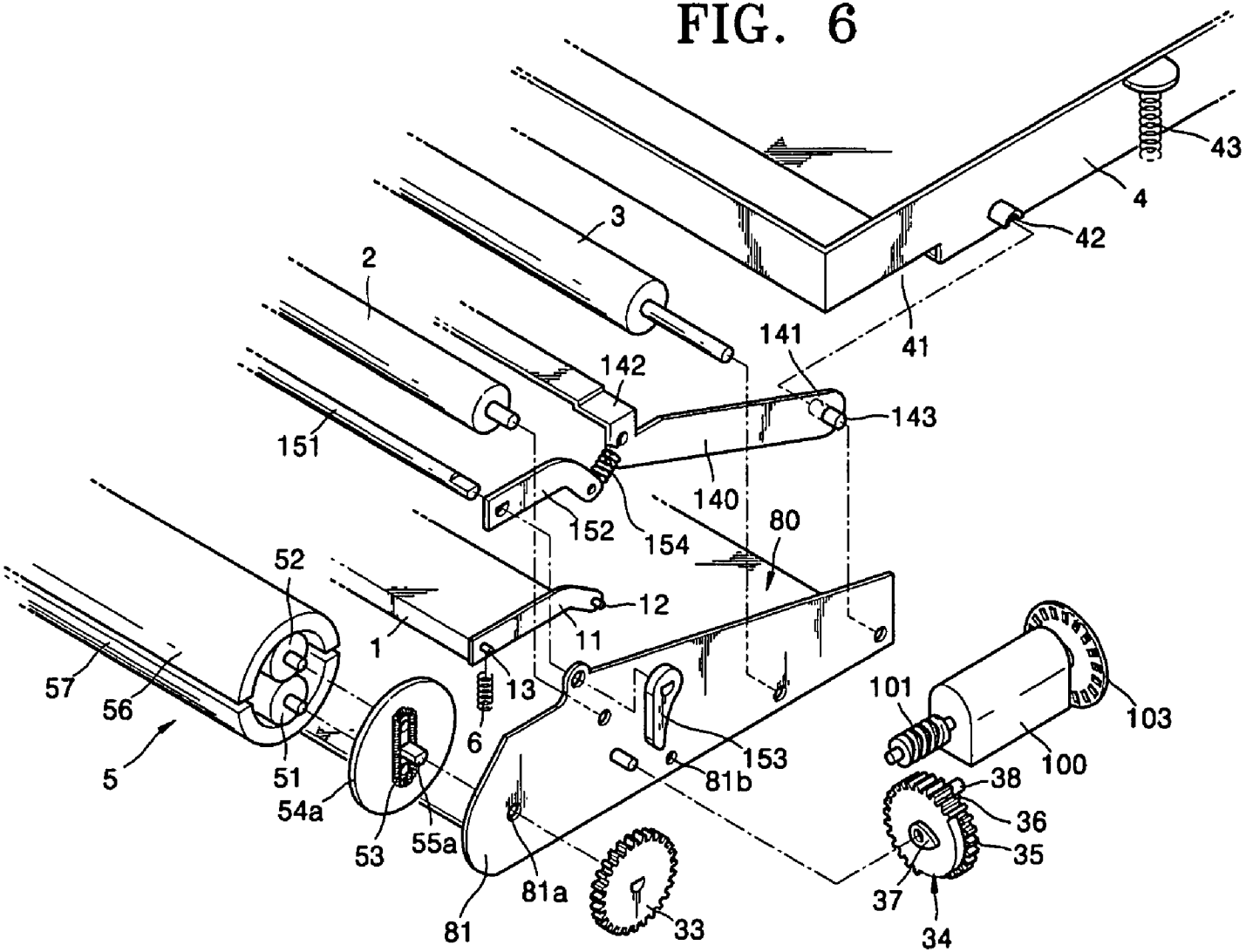
FIGS. 6 and 7 are exploded perspective views of the thermosensitive type image forming apparatus according to an exemplary embodiment of the present invention.
Figure 7:
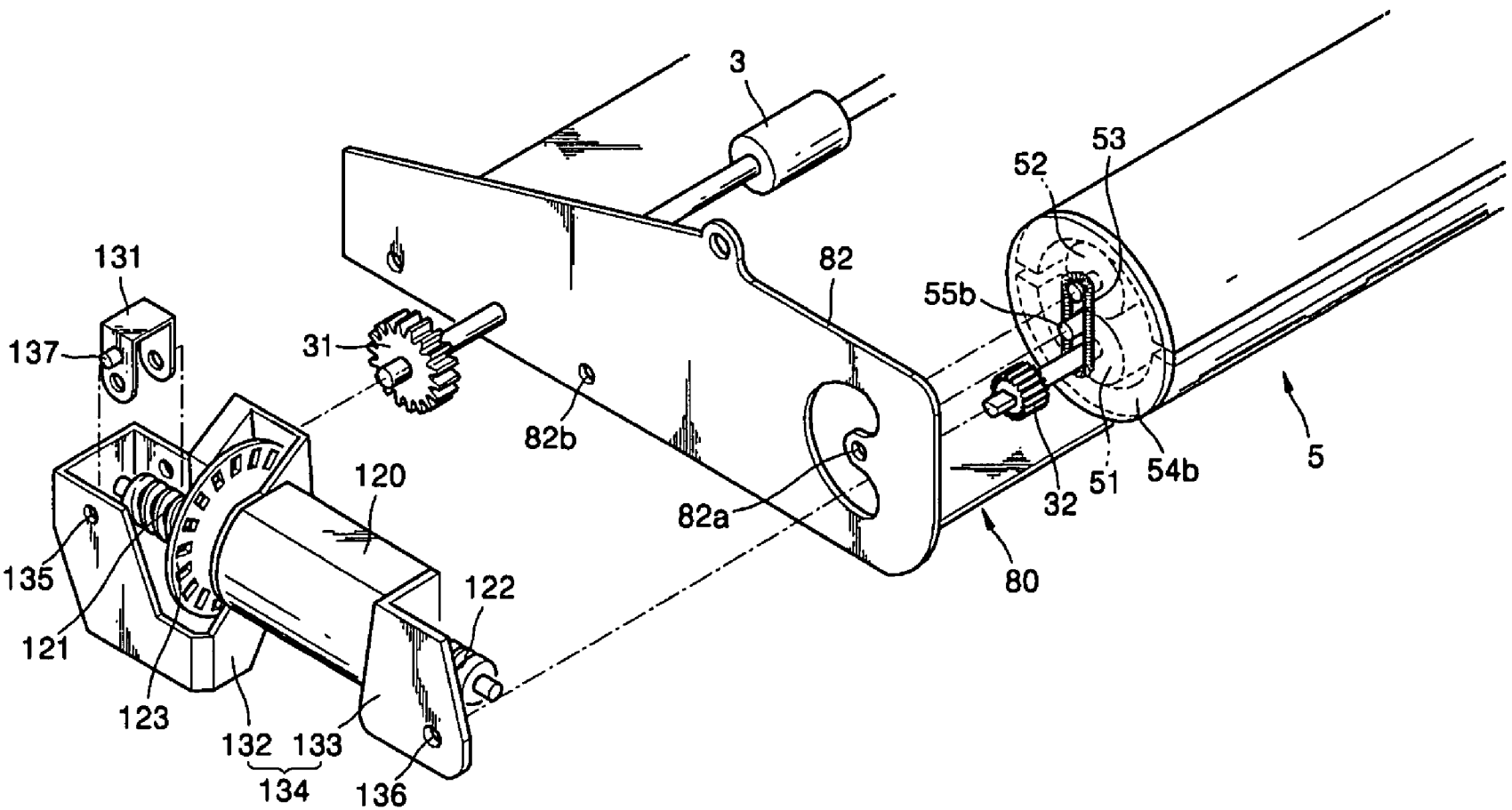

FIG. 3 is a perspective view of an image forming apparatus according to an exemplary embodiment of present invention. FIGS. 4 and 5 are perspective views of the interior of the image forming apparatus seen from different directions. FIGS. 6 and 7 are exploded perspective views of the disassembled image forming apparatus seen from different directions.

Referring to FIGS. 3 through 7, the TPH 1, the platen 2, and the transfer unit 5 are installed on a frame 80 including sidewalls 81 and 82. In an exemplary embodiment, the TPH 1 is rotatably connected to the sidewalls 81 and 82. A holder 11 including a shaft 12 is connected to both ends of the TPH 1. The shaft 12 is inserted in respective combination holes 81*b* and 82*b* of the sidewalls 81 and 82. The TPH 1 is installed to pivot according to the structure described above. The platen 2 faces the TPH 1 and supports the medium M. Although the platen 2 is a roller rotatably installed between the sidewalls 81 and 82 in an exemplary embodiment, the technical scope of the present invention is not defined by this structure. The spring 6 elastically biases the TPH 1 toward the platen 2.

The transfer unit 5 includes the driving roller 51, the driven roller 52, and supporting brackets 54*a* and 54*b*. The supporting brackets 54*a* and 54*b* rotatably support the rollers 51 and 52. The spring 53 provides an elastic force causing the two rollers 51 and 52 to contact each other. Pivots 55*a* and 55*b* are disposed in the two supporting brackets 54*a* and 54*b*. The pivots 55*a* and 55*b* are inserted in the respective combination holes 81*a* and 82*a* in the sidewalls 81 and 82. The transfer unit 5 is rotatably supported by the frame 80 according to the structure described above.

The image forming apparatus may include the tray 4 on which medium M are loaded and the pickup roller 3 that picks up one of the medium M from the tray 4. For example, the pickup roller 3 may be rotatably connected to the sidewalls 81 and 82. The tray 4 is located above the pickup roller 3. The tray 4 has the access hole 41 such that the pickup roller 3 may access the medium M.

The image forming apparatus of an exemplary embodiment includes a rotating unit that rotates the transfer unit 5 such that the first surface M1 and the second surface M2 of the medium M sequentially faces the TPH 1. Referring to FIG. 6, a rotating gear 33 is combined with the pivot 55*a* of the supporting bracket 54*a*. A worm gear 101 is combined with a pivot of a first motor 100. The rotating gear 33 may be directly engaged with the worm gear 101. When the first motor 100 is driven, the transfer unit 5 is rotated on the pivots 55*a* and 55*b*. In an exemplary embodiment of the present invention, a rotating cam 34 having a first gear unit 35 and a second gear unit 36 is disposed between the rotating gear 33 and the first motor 100. The first gear unit 35 is engaged with the worm gear 101, and the second gear unit 36 is engaged with the rotating gear 33. A rotating angle of the rotating cam 34 may be calculated based on the rotation of the first motor 100 using an encoder 103. When the first motor 100 is driven, the transfer unit 5 is pivoted about the pivots 55*a* and 55*b*. Covers 56 and 57 cover the driving roller 51 and the driven roller 52. The medium M may be easily reversed by rotating the transfer unit 5 in a state in which the medium M is pinched in the transfer unit 5. Accordingly, double-sided printing is possible using only one TPH 1. Referring to FIG. 3, the transfer unit 5 is located at one side of a housing 170, and a portion of the transfer unit 5 is exposed outside the housing 170. Since additional space for reversing the medium M is not required in the image forming apparatus, the size of the image forming apparatus may be reduced. Accordingly, the image forming apparatus having the structure shown in FIG. 3 may be applied to portable image forming apparatuses to minimize their size, such as a photo printer.

A second motor 120 drives the pickup roller 3 and the transfer unit 5. If the pivots 55*a* and 55*b* of the transfer unit 5 are concentric with the driving roller 51, the location of the driving roller 51 is not changed when the transfer unit 5 is rotated. Therefore, the second motor 120 may drive the driving roller 51 and the driven roller 52 in a fixed location. The medium M that has passed between the TPH 1 and the platen 2 is led between the driving roller 51 and the driven roller 52. If the transfer unit 5 is rotated about the driving roller 51, as indicated by a dotted line in FIG. 1A, the driven roller 52 is located under the driving roller 51. Accordingly, when the medium M is transferred to the backward A2, a guiding device (not shown) that guides the medium M to an interval between the TPH 1 and the platen 2 may be used. In an exemplary embodiment, since the pivots 55*a* and 55*b* of the transfer unit 5 are located at a point where the driving roller 51 contacts the driven roller 52, if the transfer unit 5 is rotated, the location of the point where the driving roller 51 contacts the driven roller 52 is not changed. Since the medium M is transferred forwardly and rearwardly in the directions indicated by the arrows A1 and A2 along substantially the same path, the possibility of a jam occurring may be reduced.

In another exemplary embodiment, the location of the driving roller 51 is changed when the transfer unit 5 is rotated. The image forming apparatus includes a first shifting unit that shifts the second motor 120 to maintain the second motor 120 power-connected to the pickup roller 3 and the driving roller 51 when the transfer unit 5 is rotated. Referring to FIG. 7, for example, the second motor 120 is a motor with two axes, having two driving shafts in which first and second driving gears 121 and 122 respectively engage first and second gears 31 and 32. The first and second driving gears 121 and 122 are preferably worm gears. A first bracket 131 is concentrically rotatably connected to the first gear 31. The second gear 32 is connected to an end of the driving roller 51. A first end 135 of a second bracket 134 is rotatably combined with the first bracket 131 in an eccentric position from the first gear 31. The second motor 120 is combined with the second bracket 134 such that the first and second driving gears 121 and 122 are respectively engaged with the first and second gears 31 and 32.

Figure 9A:
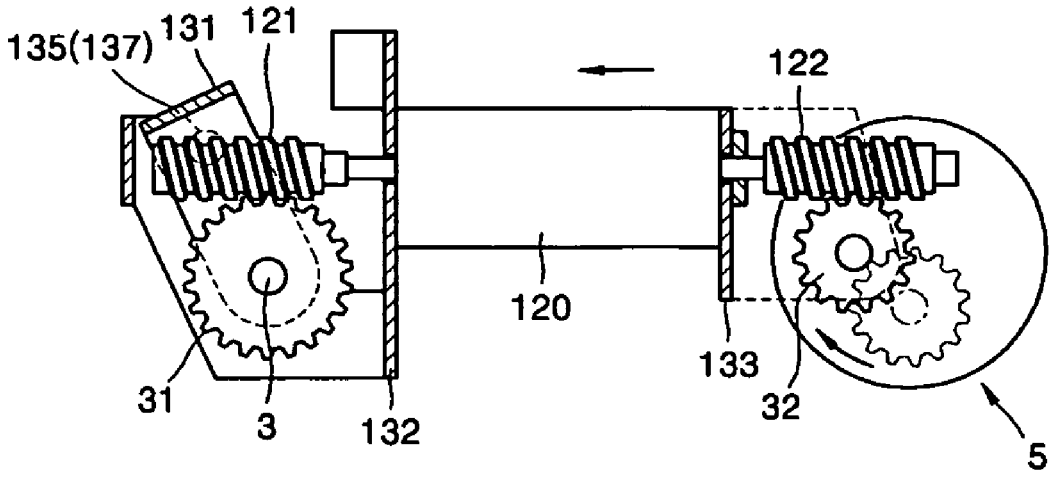
FIGS. 9A and 9B are side elevational views illustrating the operation of a first transfer unit.
Figure 9B:
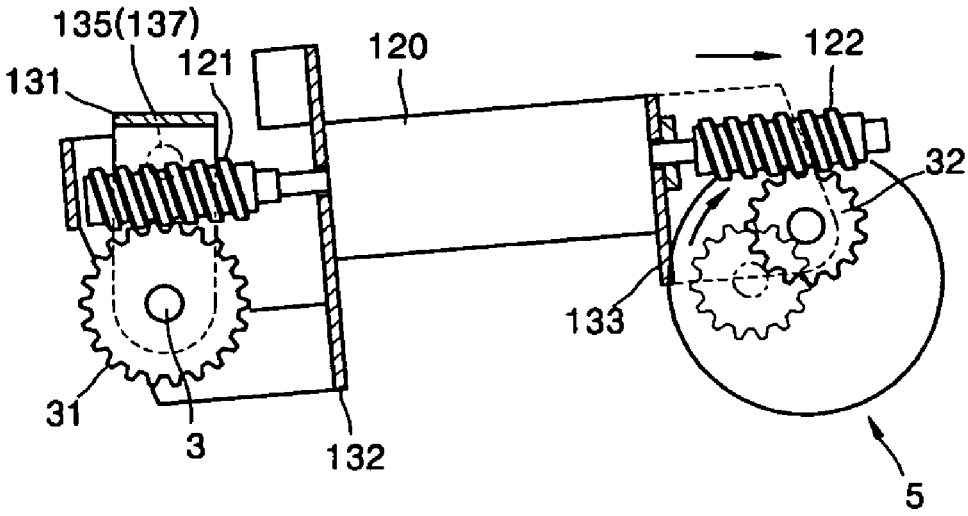

In an exemplary embodiment of the present invention, the first gear 31 is combined with an end of the pickup roller 3. Also, the first bracket is substantially U-shaped and is installed at the end of the pickup roller 3. The first bracket 131 includes a hinge 137 that is eccentric with the center of the pickup roller 3. The first end 135 of the second bracket 134 is rotatably connected to the hinge 137. The second bracket 134 includes two brackets 132 and 133 and has the first end 135 and a second end 136, respectively. The second motor 120 is connected between the two brackets 132 and 133. When the transfer unit 5 is rotated, the second gear 32 combined with the driving roller 51 pushes the second driving gear 122. Then, the second bracket 134 rotates about the first end 135 combined with the first bracket 131 and the second end 136 combined with the driving roller 51. Also, the first bracket 131 is rotated about the pickup roller 3. Accordingly, the first and second driving gears 121 and 122 are engaged with the first and second gears 31 and 32 while the transfer unit 5 is rotated. The operation of the first shifting unit is illustrated in FIGS. 9A and 9B.

The state in which the TPH 1 and the platen 2 are separated from each other when the medium M is transferred to the first and second print starting positions was described with reference to FIGS. 1A through 1I. To realize this, the image forming apparatus includes a second shifting unit that separates the TPH 1 from the platen 2. Referring to FIG. 6, a shaft 13 is connected to the holder 11 combined with the side portion of the TPH 1. A cam portion 37 is included in the rotating cam 34. The cam portion 37 pushes the shaft 13 according to a rotating angle in order to separate the TPH 1 from the platen 2. When the cam portion 37 does not contact the shaft 13, the TPH 1 contacts the platen 2 due to the elastic force produced by the spring 6. The cam portion 37 may directly push the TPH 1. Thus, an additional motor to rotate the platen 2 is not required, and the medium M is forced into contact with the platen 2, and the platen 2 is rotated while the medium M is transferred by the transfer unit 5.

In FIGS. 1A through 1I, when the medium M is picked up, the tray 4 approaches the pickup roller 3, and when the pickup is finished, the tray 4 separates from the pickup roller 3. The image forming apparatus preferably includes a third shifting unit to move the tray toward and away from the pickup roller 3.

Referring to FIGS. 4 through 7, a supporting element 140 is rotatably combined with the sidewalls 81 and 82 by a hinge 143. When the tray 4 is inserted, a concave member 42 attached to a side of the tray 4 is disposed on a shaft 141 attached to the supporting element 140. An arm portion 142 contacts an upper portion of the tray 4. Thus, the supporting element 140 pivotally supports the tray 4. In an exemplary embodiment of the present invention, the supporting element 140 is pivoted by an arm 38 included in the rotating cam 34. A lever 152 rotated by the arm 38 and a spring 154 connecting the lever 152 to the supporting element 140 are disposed between the supporting element 140 and the arm 38. The lever 152 is combined with a shaft 151 rotatably installed between the both sidewalls 81 and 82. A contacting element 153 contacting the arm 38 is combined with an end of the shaft 151. When the arm 38 pushes the contacting element 153, the shaft 151 and the lever 152 pivot. Then, since the spring 154 pulls the supporting element 140, the tray 4 is forced toward the pickup roller 3. When the arm 38 is separated from the contacting element 153, the tray 4 is returned to its original location by its own weight or a restoring force of an elastic element 43. Thus, the transfer unit 5 and the pickup roller 3 may be driven forward and backward by only the motor 120.

As described above, in an image forming apparatus according to an exemplary embodiment of the present invention, the second gear unit 36, the cam portion 37, and the arm 38 are installed on the rotating cam 34 at predetermined phase intervals to rotate the transfer unit 5, thereby driving the second and third shifting unit by using the first motor 100.

Referring to FIGS. 8A through 8I, 9A and 9B, and 1A through 1I, the operations of the rotating unit and the first, second, and third shifting units are described below.

Figure 8A:
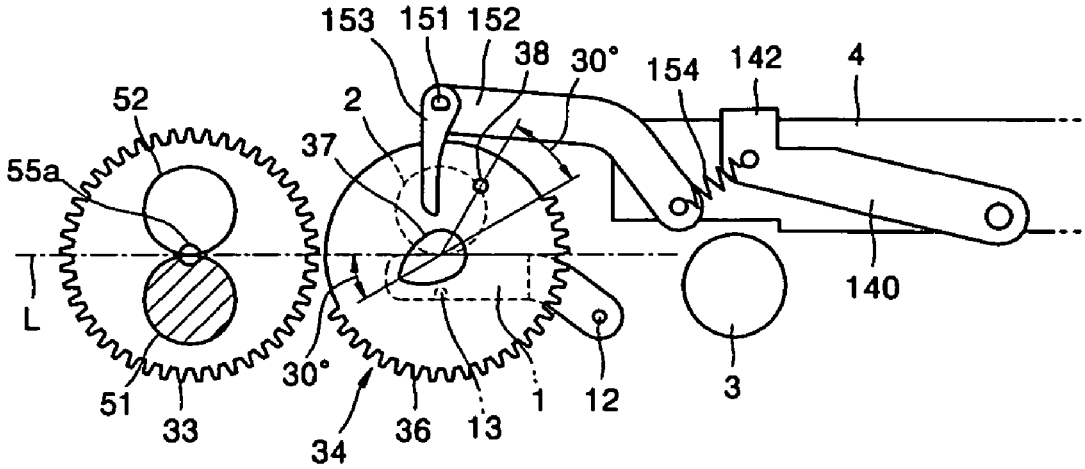
FIGS. 8A through 8H are diagrams illustrating the operation of the image forming apparatus according to an exemplary embodiment of the present invention.

FIG. 8A illustrates a print standby position, that is, the same position as illustrated in FIG. 1A. In an exemplary embodiment of the present invention, the center of rotation of the rotating cam 34 is located at a point of contact between the TPH 1 and the platen 2. Also, the pivot 55*a* of the transfer unit 5 is located on a base line L along with the point of contact between the TPH 1 and the platen 2. Referring to FIG. 8A, phases of the second gear unit 36, the cam portion 37, and arm 38 will now be described. The second gear unit 36 is formed over approximately 180 degrees to not engage the rotating gear 33, for example, from a location that is far from the base line L counterclockwise by approximately 30 to approximately 210 degrees. The cam portion 37 is in the same phase as the second gear unit 36 when both are in their start positions. The arm 38 is located approximately 30 degrees counterclockwise from an end of the second gear unit 36. The shaft 13 is located at a position that is far from the cam portion 37 counterclockwise by approximately 60 degrees. The TPH 1 contacts the platen 2, and the tray 4 is separated from the pickup roller 3. Referring to FIG. 4, in the second motor 120, the first and second driving gears 121 and 122 are respectively engaged with the first and second gears 31 and 32.

Figure 8B:
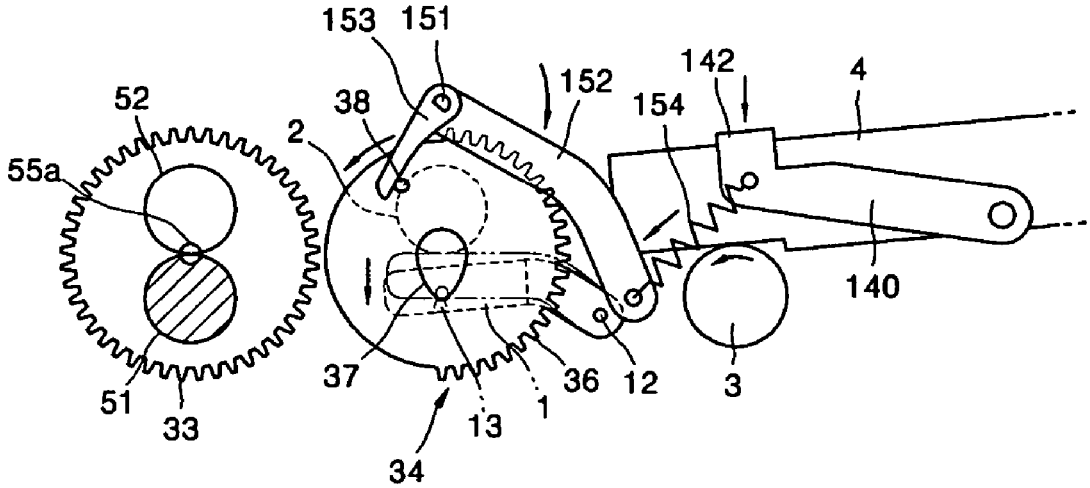

The operation of picking up the medium M from the tray 4 will now be described. The first motor 100 rotates the rotating cam 34 approximately 60 degrees counterclockwise, for example. Referring to FIG. 8B, the arm 38 pushes the contacting element 153 to rotate the shaft 151. The lever 152 combined with the shaft 151 is rotated, and the spring 154 pulls the supporting element 140 down. The supporting element 140 is rotated on the hinge 143, and the arm portion 142 pushes the tray 4. The tray 4 pivots on the shaft 141 and approaches the pickup roller 3. The pickup roller 3 contacts the medium M via an access hole 41. Also, the cam portion 37 pushes the shaft 13, thereby separating the TPH 1 from the platen 2. At this point, the image forming apparatus enters the position shown in FIG. 1B. In the position shown in FIG. 1B, when the second motor 120 is driven, the pickup roller 3 extracts the medium M from the tray 4 and transfers the medium M to the transfer unit 5. After the first end FE of the medium M passes the transfer unit 5 and the medium M is located at the first print starting position, the second motor 120 stops.

Figure 8C:
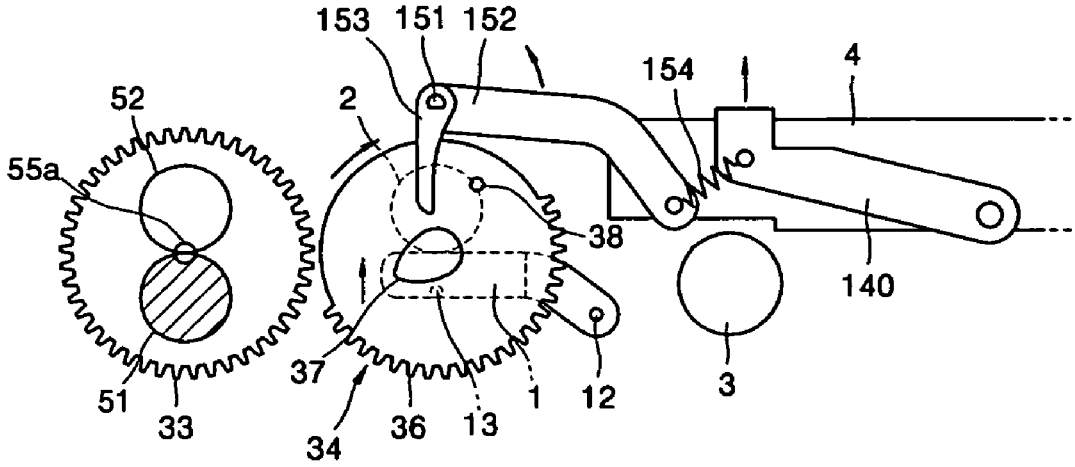

Referring to FIG. 8C, the first motor 100 is rotated clockwise by 60 degrees. The tray 4 is returned to its original location by its own weight or the restoring force of the elastic element 43. The lever 152, the shaft 151, and the arm 38 are returned to there original locations by a restoring force of the spring 154. When the cam portion 37 and the shaft 13 are separated from each other, the TPH 1 approaches the platen 2 by the restoring force of the spring 6, and the medium M contacts the TPH 1. At this position, the image forming apparatus enters the state illustrated in FIG. 1C. Next, the second motor 120 is driven, and the transfer unit 5 transfers the medium M forwardly in the direction indicated by arrow A1 at a predetermined printing speed. The TPH 1 applies heat to the first surface M1 of the medium M according to image information, thereby printing an image. When the image being formed on the first surface M1 is finished, the second motor 120 stops before the rear end RE of the medium M exists the transfer unit 5.

Figure 8D:
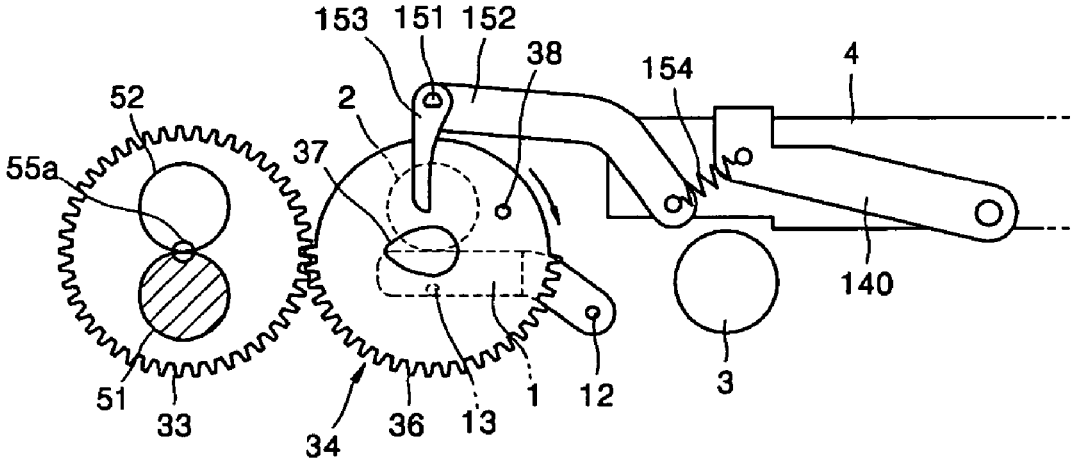
Figure 8E:
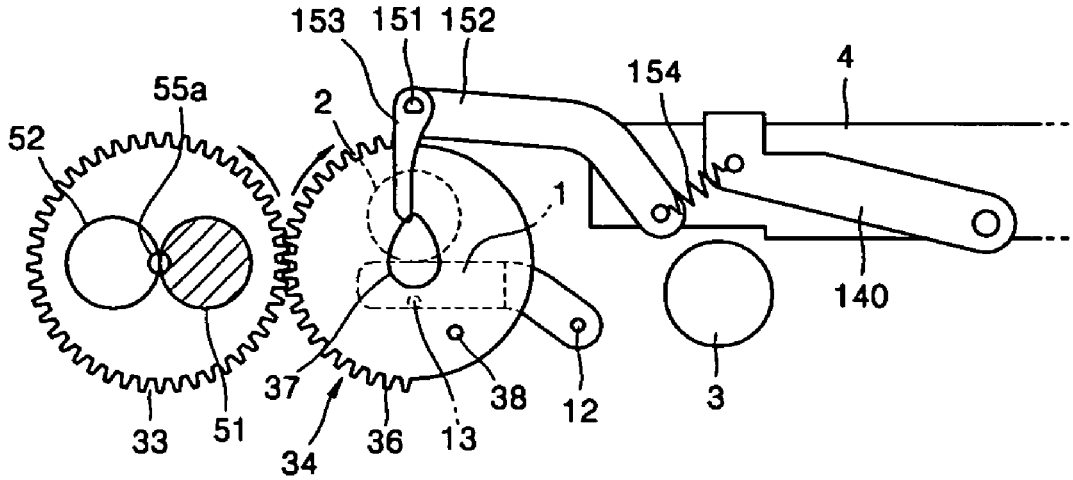
Figure 8F:
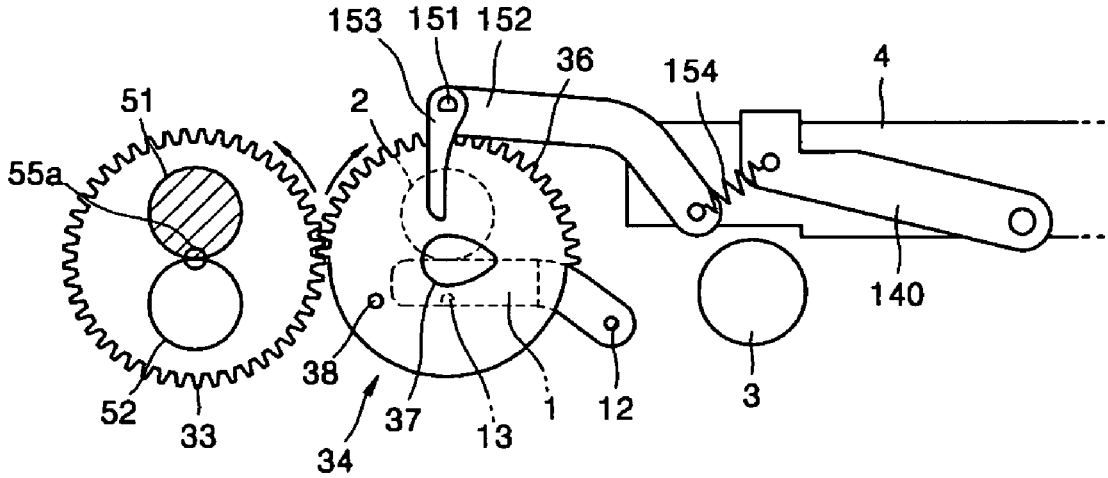

Referring to FIG. 8D, the first motor 100 rotates the rotating cam 34 clockwise. When the rotating cam 34 is rotated by approximately 30 degrees, the second gear unit 36 engages with the rotating gear 33. As the rotating cam 34 rotates further, for example, by a further 90 degrees, the driving roller 51 and the driven roller 52 are located on the base line L as shown in FIG. 8E. In this case, referring to FIG. 9A, the first and second brackets 131 and 134 are smoothly pivoted to maintain a position in which the first and second driving gears 121 and 122 of the second motor 120 are substantially continuously engaged with the first and second gears 31 and 32. At this point, the image forming apparatus enters the state illustrated in FIG. 1E. In this position, the second motor 120 drives the transfer unit 5 to transfer the medium M and stops before the front end FE of the medium M exists the transfer unit 5. At this point, the image forming apparatus enters the position illustrated in FIG. 1F.

The first motor 100 rotates the rotating cam 34 clockwise by approximately 90 degrees. Then, referring to FIG. 8F, the driving roller 51 is located above the driven roller 52. The second surface of the medium M faces the TPH 1 as shown in FIG. 1G. Referring to FIG. 9B, since the first and second brackets 131 and 134 are properly pivoted, the second motor 120 is disposed such that the first and second driving gears 121 and 122 are engaged with the first and second gears 31 and 32.

Figure 8G:
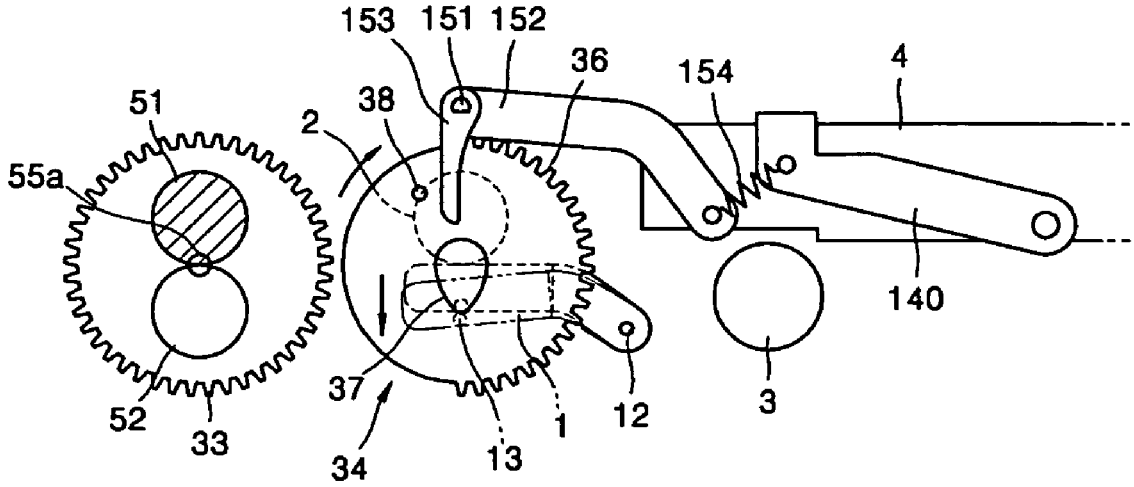

To transfer the medium M to the second print starting position, referring to FIG. 8G, the first motor 100 rotates the rotating cam 34 clockwise by approximately 90 degrees. Then, the cam portion 37 pushes the shaft 13 to separate the TPH 1 from the platen 2. Since the second gear unit 36 and the rotating gear 33 are no longer engaged, the transfer unit 5 is not rotated. The second motor 120 drives the transfer unit 5 to transfer the medium M to the second print starting position. When the medium M is located at the second print starting position, the second motor 120 is stopped.

Figure 8H:
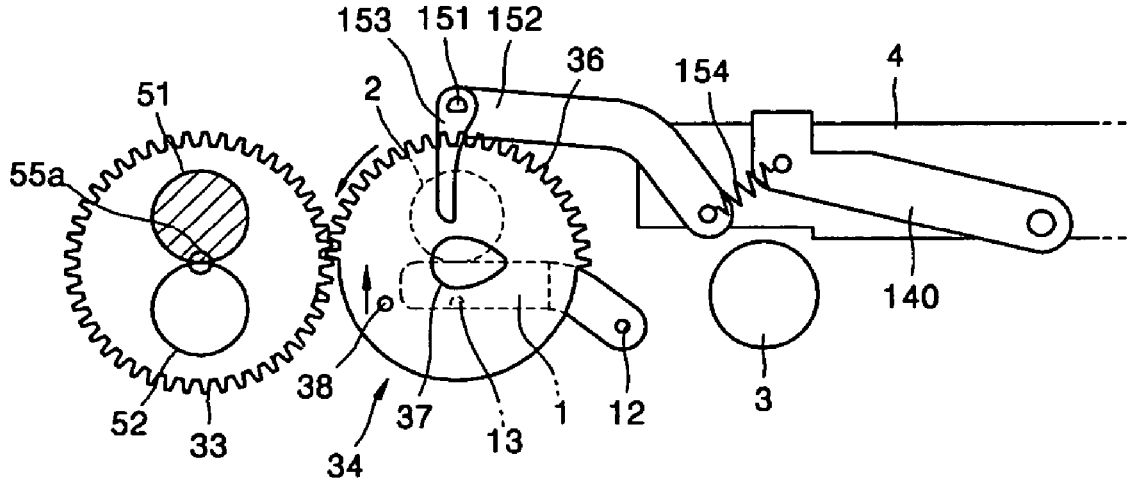

The first motor 100 rotates the rotating cam 34 counter-clockwise to separate the cam portion 37 from the shaft 13, as shown in FIG. 8H. Then, the TPH 1 approaches the platen 2 by the biasing force of the spring 6, and the medium M contacts the TPH 1. The second motor 120 drives the transfer unit 5 to transfer the medium M forward in the direction indicated by the arrow A1 at a predetermined printing speed. The TPH 1 applies heat to the second surface M2 of the medium M according to image information, thereby printing an image.

An image forming apparatus may include one or more sensors for detecting a location of the medium M. A process detecting the medium M and transferring the medium M to the first and second print starting position may be applied to the image forming apparatus and method according to an exemplary embodiment of the present invention by those of ordinary skill in the art. Accordingly, a detailed description thereof is omitted. The encoder 103 and an encoder 123 detect the amount of rotation of the first and second motors 100 and 120, respectively.

A thermosensitive image forming apparatus has been described, but the technical scope of the image forming apparatus for double-sided printing according to the present invention is not limited by the printing type. If the transfer unit 5 is installed at an exit side of the printing module 7 and a rotating unit rotating the transfer unit 5 is included, the image forming apparatus according to an exemplary embodiment of the present invention may be applied to image forming apparatuses employing various printing methods, such as inkjet image forming apparatuses and electrophotographic image forming apparatuses. The image forming apparatus may further include a main transfer unit (not shown) to transfer the medium M at a predetermined speed, and the transfer unit 5 installed at the exit side of the printing module 7 may be an assistant unit.

As described above, the following effects may be obtained by the image forming apparatus according to an exemplary embodiment of the present invention.

First, double-sided printing may be performed by one printing module. Accordingly, the manufacturing cost of an image forming apparatus may be reduced.

Second, a transfer unit is rotated to transfer a medium, thereby reversing the medium with a simple structure. Also, a complicated medium transfer path is not required to reverse the medium. Accordingly, the size of image forming apparatuses may be minimized, and the occurrence of paper jams may be decreased.

Third, since the center of rotation of the transfer unit is determined such that a medium is transferred forward and backward along the same path, a transfer path of the medium is simplified.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus, comprising:

a printing module that prints an image on a medium;

a transfer unit that transfers the medium;

a rotating unit that rotates the transfer unit such that first and second surfaces of the medium selectively face the printing module when the medium is pinched in the transfer unit; and a housing houses the printing module, the transfer unit and the rotating unit, and the transfer unit is exposed to outside the housing.

2. The apparatus of claim 1, wherein, the medium is a thermosensitive medium in which ink layers formed on both sides of the medium react with heat to reveal a predetermined color, and the printing module has a thermal printing head that applies heat to the medium to form an image.

3. The apparatus of claim 2, wherein the rotating unit has a rotating gear combined with a pivot of the transfer unit and a first motor to rotate the rotating gear.

4. The apparatus of claim 3, wherein the transfer unit has a driving roller and a driven roller that are engaged with each other to transfer the medium.

5. The apparatus of claim 2, wherein the transfer unit has a driving roller and a driven roller that are engaged with each other to transfer the medium; and the image forming apparatus has a feeding device in which the medium are loaded,a pickup device that extracts the medium from the feeding device, and a second motor that drives the driving roller and the pickup device.

6. The apparatus of claim 5, wherein a first shifting unit shifts the second motor to maintain power connection between the second motor and the pickup device and the driving roller.

7. The apparatus of claim 6, wherein a first gear is power-connected to the pickup device and a second gear is connected to an end of the driving roller, and the second motor is a two-axes motor having two driving shafts in which the first and second driving gears respectively engage the first and second gears.

8. The apparatus of claim 7, wherein the first shifting unit includes a first bracket concentrically rotating with respect to the first gear and a second bracket in which the second motor is installed, the second bracket has a first end pivotably connected to the first bracket in an eccentric position from the first gear, and a second end concentrically pivoting with the driving roller.

9. The apparatus of claim 8, wherein the first gear is connected to an end of the pickup device.

10. The apparatus of claim 9, wherein the first bracket is connected to the pickup device, and the second end of the second bracket is pivotably connected to the driving roller.

11. The apparatus of claim 2, wherein the printing module includes a platen that faces the thermal printing head to support the medium and an elastic element that elastically biases the thermal printing head toward the platen.

12. The apparatus of claim 11, wherein the platen rotates with the medium and is rotated while the medium is transferred by the transfer unit.

13. The apparatus of claim 12, wherein a second shifting unit selectively separates the thermal printing head from the platen.

14. The apparatus of claim 13, wherein the rotating unit includesa rotating gear connected to a pivot of the transfer unit, a rotating cam has a second gear unit engaged with the rotating gear and a first gear unit disposed concentrically with the second gear unit;

a first motor connected to the first gear unit to rotate the rotating cam, and the second shifting unit is driven by the first motor.

15. The apparatus of claim 14, wherein the second shifting unit has a cam portion disposed eccentrically to the rotation center of the rotating cam and pushes and separates the thermal printing head from the platen according to a rotation angle of the rotating cam.

16. The apparatus of claim 2, wherein the medium is loaded in a feeding device;

a pickup device extracts the medium from the feeding device; and a third shifting unit shifts the feeding device toward the pickup device when picking up the medium and separates the feeding device from the pickup device when the medium has been extracted.

17. The apparatus of claim 16, wherein the rotating unit includes a rotating gear connected to a pivot of the transfer unit;

a rotating cam having a second gear unit engaged with the rotating gear and a first gear unit disposed concentrically with the second gear unit;

a first motor connected to the first gear unit to rotate the rotating cam, and the third shifting unit is driven by the first motor.

18. The apparatus of claim 17, wherein the third shifting unit has an arm that is formed in the rotating cam eccentrically with the rotation center of the rotating cam and a supporting element that supports the feeding device and that pivots in a direction in which the feeding device is approached to the pickup device by the arm according to a rotation angle of the rotating cam.

19. The apparatus of claim 18, wherein the third shifting unit has a lever pivoted by the arm according to the rotation angle of the rotating cam and an elastic element that elastically connects the lever to the supporting element.

20. The apparatus of claim 2, wherein the medium is a color printing medium in which ink layers representing different colors are formed on both sides of the medium such that the colors overlap to form a color image after printing is performed.

21. An image forming method performed by an image forming apparatus having a printing module that prints an image on a medium and a transfer unit that is located at an exit side of the printing module to transfer the medium, the method comprising facing a first surface of the medium toward the printing module and positioning the medium at a first print starting position;

transferring the medium and printing an image on the first surface of the medium using the printing module;

rotating the transfer unit to face a second surface of the medium toward the printing module when a rear end of the medium is pinched in the transfer unit;

transferring the medium to position the medium at a second print starting position; and transferring the medium and printing an image on the second surface of the medium using the printing modules, wherein the transfer unit is exposed to outside a housing which houses the printing module, the transfer unit and the rotating unit.

22. The method of claim 21, wherein the facing the first surface of the medium toward the printing module further comprises moving a feeding device in which the medium is loaded toward a pickup device;

rotating the pickup device to extract the medium; and returning the feeding device to an original position after the medium has been extracted.

23. The method of claim 21, wherein the rotating the transfer unit further comprises:

rotating the transfer unit by a predetermined angle when the rear end of the medium is pinched in the transfer unit;

transferring and stopping the medium before a front end of the medium leaves the transfer unit; and rotating the transfer unit until the second surface of the medium faces the printing module.

24. The method of claim 21, wherein the medium is a color printing medium in which ink layers representing different colors are formed on both sides of the medium, the printing module has a thermal printing head that applies heat to the medium to form an image, and different colors overlap when printing on both sides of the medium is finished.

25. The method of claim 21, wherein the printing module prints images on the medium using an electrophotographic method, an inkjet method, or a thermal transfer method.

* * * * *